US006123126A

United States Patent [19]

Shanahan et al.

[11] Patent Number: 6,123,126

[45] Date of Patent: Sep. 26, 2000

[54] DOVETAILING AND DOVETAIL ASSEMBLY MACHINE

[75] Inventors: James William Shanahan; Bobby Allen Mihlhauser, both of Mount Pleasant, Tex.

[73] Assignee: Mastercraft Industries, L.P., Mount Pleasant, Tex.

[21] Appl. No.: 09/347,115

[22] Filed: Jul. 2, 1999

[51] Int. Cl.[7] ..... B27F 1/00; B27C 5/00; B27M 1/00

[52] U.S. Cl. ..... 144/371; 144/2.1; 144/84; 144/136.1; 144/347; 144/85

[58] Field of Search ..... 144/1.1, 2.1, 3.1, 144/84, 85, 87, 136.1, 345, 346, 347, 352, 371, 82

[56] References Cited

U.S. PATENT DOCUMENTS 4,127,153 11/1978 Cipollone ..... 144/85

*Primary Examiner*—W. Donald Bray

[57] ABSTRACT

The present invention provides a dovetailing and assembly machine that forms a groove on the planar surface of a first workpiece and inserts a preformed tenon on one end of a second workpiece into the groove. In one embodiment the groove is dovetail-shaped. The present invention also provides for a method to manufacture a dovetailing and assembly machine. In one embodiment the machine comprises: (1) a frame, (2) a jig coupled to the frame and adapted to hold a first workpiece, (3) a router coupled to the frame and adapted to move relative to a planar surface on the first workpiece and to cut a groove thereon, (4) a mount coupled to the frame to hold the tenon in substantial alignment with the groove and (5) a press coupled to the frame adapted to press the tenon into the groove.

21 Claims, 4 Drawing Sheets

DOVETAILING AND DOVETAIL ASSEMBLY MACHINE

TECHNICAL FIELD OF THE INVENTION

The present invention is directed, in general, to assembly machines and, more specifically, to a machine that forms a groove on the planar surface of a first workpiece and assembles a product by inserting a tenon on a second workpiece in the groove.

BACKGROUND OF THE INVENTION

Dovetail joints are well known and widely used to securely interlock two pieces of wood. Historically, such joints have been widely used in the construction of furniture as well as in the manufacture of shelving, wood containers and fence structures.

A dovetail joint is formed by cutting a female dovetail-shaped groove in a piece of wood and inserting a matching male tenon at the end of a second piece of wood in the groove. A dovetail-shaped groove is a groove with the bottom of the groove wider than the top so that the two sides of the groove have opposing slants. The tenon on the second piece of wood is held in the groove by a wedging action, which forms a very strong joint. The inherent strength of such joints, provided the tenon and groove are properly cut to match, makes them a favored method in the furniture industry to join wood pieces together. Dovetail joints are also widely used in the manufactured shelving business to join supports to the shelves.

Dovetail joints are favored in the manufactured shelving business, not only because of the strength of such joints, but also because the joint can be made so it is not visible when the shelf is hung on a wall or other supporting surface. In most cases the dovetail groove is started from the shelf edge that is to be mounted against the wall. This means the tenon on the shelf support is inserted in the groove from the back edge. Because the groove is not usually cut across the entire planar surface of the shelf, the outline of the dovetail joint is not visible when the shelf is installed. This gives such shelving an attractive appearance as well as providing a strong support for relatively heavy loads. Such shelving can be made in any length and with any number of supports.

Notwithstanding the obvious benefits of using dovetail joints to construct and manufacture shelving and furniture, there are several disadvantages. One disadvantage is that a dovetail joint should be precisely sized. The joint can tolerate little or no variance between the size of the female dovetail groove and the male tenon. If the tenon is too small, the two pieces will not achieve an interference fit and may easily come apart. If the tenon is oversized, the two pieces of wood will prove difficult to join without the use of force, which force could damage the shelf by chipping or splintering the edges of the dovetail groove or the tenon. Because such precision is required, the forming and assembly of products using dovetail joints may be more expensive than using other techniques. Even if a near perfect fit of the tenon into the dovetail groove is achieved, age related shrinkage caused by drying of the wood, as well as swelling and shrinkage caused by variable humidity conditions, may cause the joint to loosen. This is why dovetail joints are typically held together by dowels or by an adhesive. Manufacturing costs are increased when a dowel is required or adhesive is used because additional raw materials are required and an additional manufacturing step to apply the adhesive or install the dowel is required.

An alternative to the use of adhesive or dowels to secure dovetail joints is to use a friction fit. That is, make the tenon slightly larger than the dovetail groove and rely on friction to hold the two pieces together. When shelving is made that relies on a friction fit to hold the pieces together, the problems of an uneven or excessive application of force to join the two pieces should be addressed. If excessive force is used, the shelving materials can be damaged by chipping or splintering the edges of the groove or tenon, thereby causing a loss of materials that adversely affects the economics of the manufacturing process. Such problems become even more pronounced if soft wood materials, such as white pine, are used.

While shelving and other like items can be manufactured by forming a dovetail groove with a router and either manually forcing an oversized tenon into the groove, to get a friction fit to hold the pieces together, or by securing the tenon in the groove with an adhesive or a dowel, such methods are not cost effective when a large number of relatively inexpensive shelves are to be manufactured. To be economically competitive, such shelving should be assembled as efficiently as possible using low cost techniques. In addition, it is critical that the manufacturing process provide a level of quality control that assures the production of a consistent product.

Accordingly, what is needed in the art is a machine that can cut a groove on the surface of a workpiece, such as piece of soft wood, and insert the tenon at the end of a second workpiece, also a piece of soft wood, into the groove on the first workpiece.

BRIEF SUMMARY OF THE INVENTION

To address the above-discussed deficiencies of the prior art, the present invention provides a dovetailing and assembly machine that forms a groove on the planar surface of a first workpiece and inserts a preformed tenon on one end of a second workpiece into the groove. The present invention also provides for a method to manufacture a dovetailing and assembly machine. One embodiment of the machine comprises: (1) a frame, (2) a jig coupled to the frame and adapted to hold a first workpiece, (3) a router coupled to the frame and adapted to move relative to a planar surface on the first workpiece and to cut a groove thereon; (4) a mount coupled to the frame to hold the tenon in substantial alignment with the groove and (5) a press coupled to the frame adapted to press the tenon into the groove.

In broad scope, the present invention introduces a machine that can cut a groove on the planar surface of a first workpiece and insert the precut tenon on a second workpiece tenon into the groove. Such a machine can be used to a particular advantage in the manufacture and assembly of shelving where the first workpiece is the shelf and the second workpiece is a support for the shelf. In a particularly advantageous embodiment, the router cuts a dovetail-shaped groove on the planar surface of the first workpiece. If the dovetail groove is cut slightly smaller than the tenon, a friction fit can be used to secure the two pieces. Thus, this invention facilitates the assembly of shelving by permitting the insertion of a slightly larger tenon into a dovetail cut. It will, of course, be apparent to those skilled in the art that the tenon can be secured in the groove by an adhesive or dowel and still be within the scope of the claimed invention.

In another embodiment, the machine has at least two stations. The router is coupled to the frame of the machine at the first station and a mount is coupled to the frame of the machine at the second station to hold the tenon on the second workpiece in alignment with the groove on the first workpiece. This embodiment also calls for the press to be mounted on the frame of the machine at the second station. Another aspect of the invention provides for a jig configured to hold and carry the first workpiece from the first station to the second station.

In yet another aspect of the present invention, a feeder rack is coupled to the frame at the second station to supply the second piece to the mount. A further refinement calls for the rack to hold a plurality of second pieces.

In another embodiment of the invention the press is comprised of a cylinder and a reciprocating piston adapted to press the tenon into the groove. An additional aspect of this embodiment calls for the coupling of a pneumatic source to the cylinder to operate the piston.

The present invention also provides for a method of manufacturing a dovetailing and assembly machine. The method, in one embodiment, comprises: (1) forming a frame; (2) coupling to the frame a jig that is adapted to hold a first workpiece; (3) coupling a router to the frame that is adapted to move relative to a planar surface on the first workpiece and to cut a groove therein; (4) coupling a mount to the frame that holds the precut tenon at the end of the second workpiece in substantial alignment with the groove; and (5) coupling a press to the frame that is adapted to press the tenon into the groove.

The foregoing has outlined, rather broadly, preferred and alternative features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and one or more specific embodiments as a basis for designing or modifying other structures for carrying out the same purposes of the present invention. Those skilled in the pertinent art should also realize that such equivalent constructions do not depart from the spirit and scope of the invention in its broadest form or the claims.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
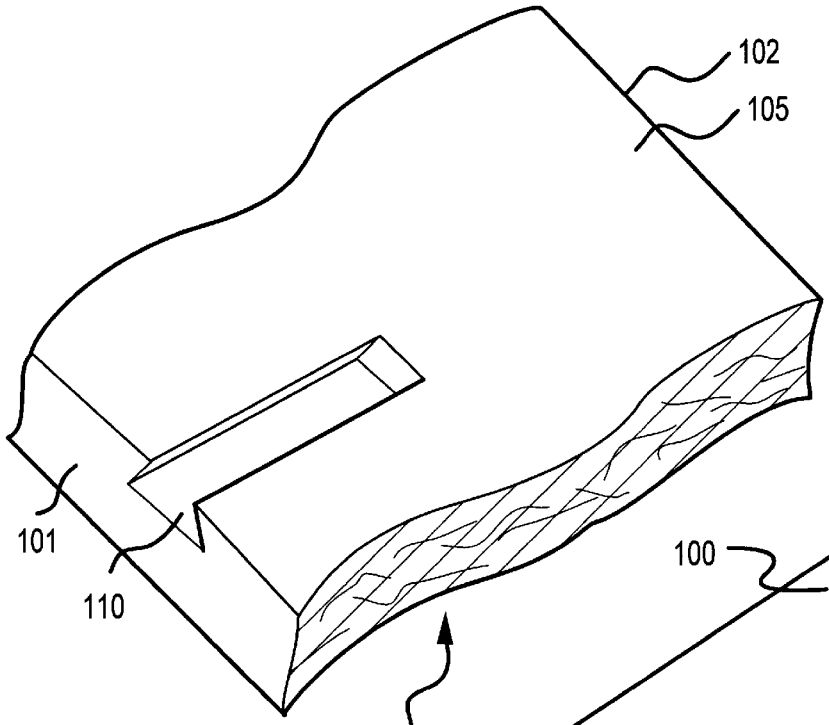
FIG. 1*a* illustrates a first workpiece, a shelf, with a dovetail groove cut on one planar surface.
Figure 1C:
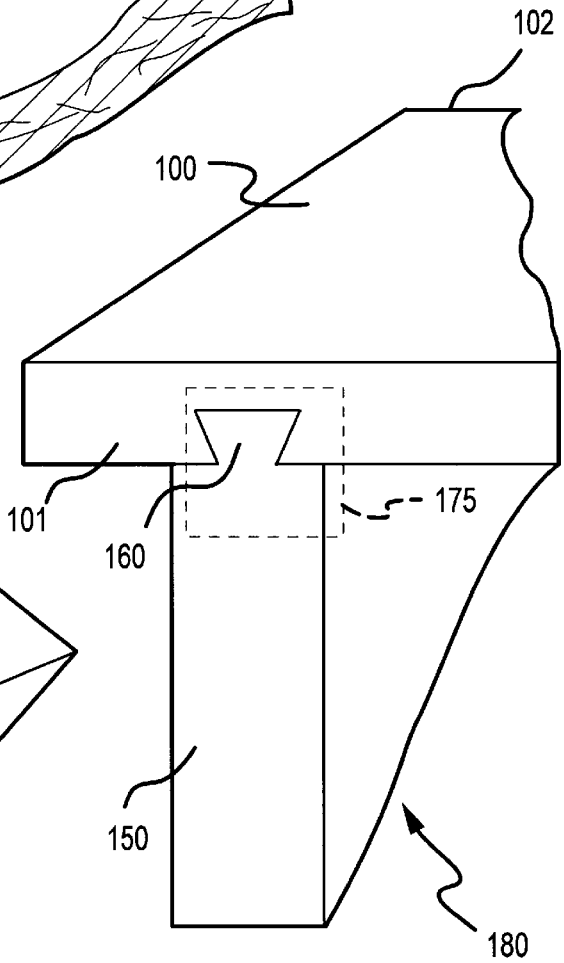
FIG. 1*c* illustrates the back edge of a completed shelf assembly and the dovetail joint where the shelf and shelf support are joined together.
Figure 1B:
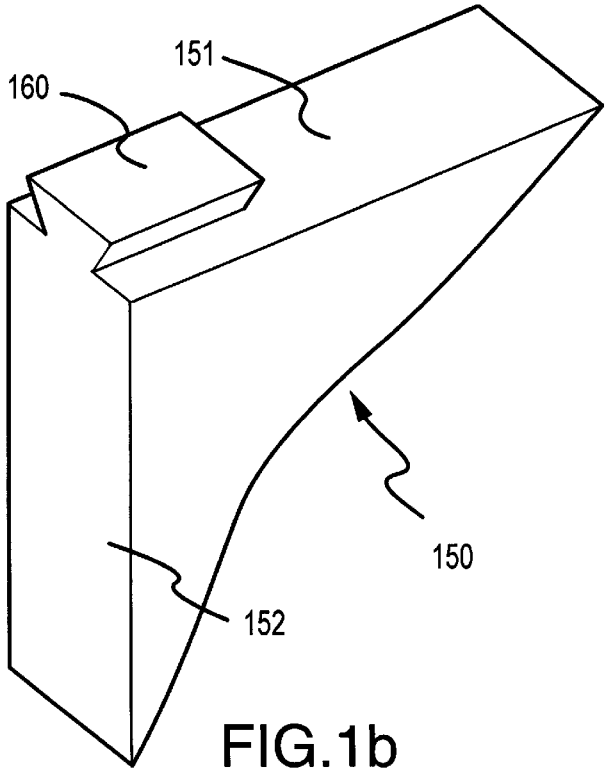
FIG. 1*b* illustrates a second workpiece, a shelf support, with a tenon formed on one edge.

Referring initially to FIG. 1*a*, illustrated is a first workpiece, a shelf 100, with a dovetail groove 110 cut on one planar surface 105. FIG. 1*b* illustrates a second workpiece, a shelf support 150, with a tenon 160 formed on one edge 151. FIG. 1*c* illustrates the back edge 101 of a completed shelf assembly 180 and the dovetail joint 175 (outlined in dashed lines) where the shelf 100 and shelf support 150 are joined together.

The shelf 100 illustrated in FIG. 1*a* has a dovetail-shaped groove 110 cut on one surface 105, starting from the back edge 101 of the shelf 100. Those skilled in the art will understand that other shapes of grooves 110 are within the scope of the invention. To conceal the end of the dovetail joint 175, the groove 110 is cut to traverse only a portion of the planar surface 105 of the shelf 100. Thus, when the assembled shelf 180 is mounted with the front edge 102 facing the viewer, the rear edge 101 will be against a wall and the joint 175 will be hidden.

The tenon 160 is precut on the edge 151 of the shelf support 150 using any one of a number of well-known methods to cut tenons. The tenon 160 is advantageously cut with the same shape and be substantially the same size as the groove 110. The dovetail joint 175 is completed by pressing the tenon 160 on the shelf support 150 into the dovetail groove 110 on the surface 105 of the shelf 100. In a typical prior art dovetail joint 175, the tenon 160 may also be secured in the groove 160 by an adhesive or a dowel.

Figure 2A:
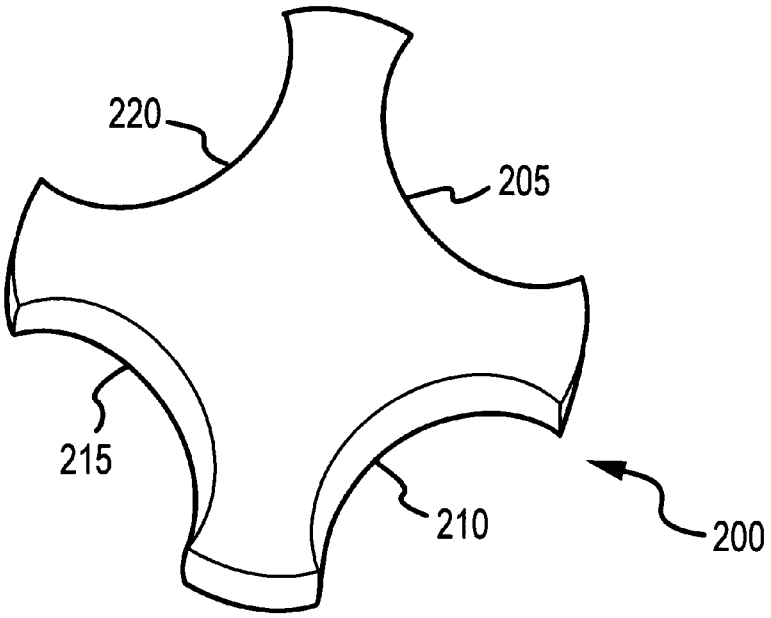
FIG. 2*a* illustrates a jig adapted to hold a first workpiece.
Figure 2B:
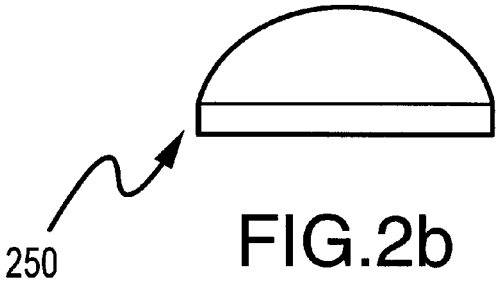
FIG. 2*b* illustrates a shelf, which is the first workpiece, that is held by the jig.
Figure 2C:
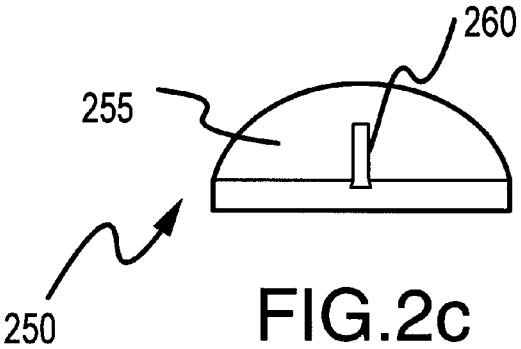
FIG. 2*c* illustrates a shelf with a groove cut on its planar surface.

Turning now to FIG. 2*a*, illustrated is a jig 200 adapted to hold a first workpiece. Consistent with the remainder of the description herein, the first workpiece is a shelf 250. FIG. 2*b* illustrates the shelf 250 and FIG. 2*c* illustrates the shelf 250 with a groove 260 cut on its planar surface 255. For illustration purposes, the jig 200 in FIG. 2*a* is adapted for use on a four position dovetailing and assembly machine having a support frame (see FIG. 3 and two operating stations. The jig 200 is loaded with a shelf 250 at the first position 205 and rotated to a second position 210 where a router coupled to the frame of the machine performs the first operation of cutting a groove 260 in the surface 255 of the shelf 250. After the groove 260 is cut, the jig 200 is rotated to a third position 215 where the second operating station attaches the shelf support 150. The jig 200 then rotates to a fourth position where the completed shelf assembly 180 is removed. Those skilled in the art will recognize that a jig 200 can have a number of different designs, depending on the style or type of machine being used and the kind and shape of the first workpiece. For example, a jig 200 could be designed for a machine that has a single position where all the steps are performed or it could be designed for a machine that moves products laterally instead of in a rotary fashion.

Figure 3:
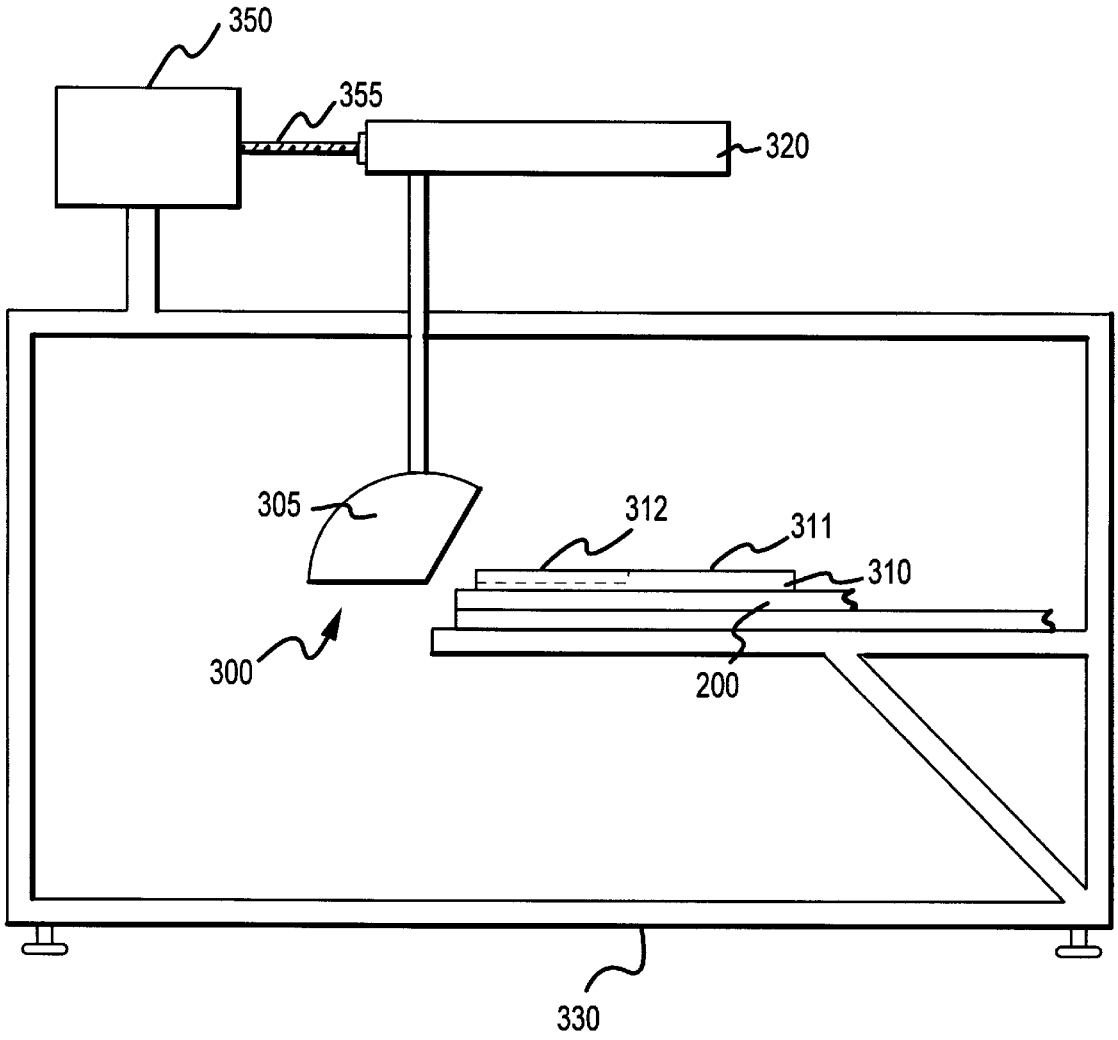
FIG. 3 illustrates a representation of a router adapted to move relative to a planar surface on a first workpiece and to cut a groove thereon.

Turning now to FIG. 3, illustrated is a representation of a router 300 adapted to move relative to a planar surface 311 on a shelf 310 and cut a groove 312 thereon. The router 300 is coupled to a frame 330 of the machine and configured so that the router head 305 can move relative to the planar surface 311 of the self 310 by following a track 320. As the router head 305 moves along the track 320, it cuts a groove 312 in the shelf 310, the depth and length of which are preset using established techniques.

A number of methods can be used to move the router head 305 along the track 320 and across the surface 311 of the shelf 310. The illustrated method provides for a screw mechanism 355 housed in a screw housing 350 that pushes the router head 305 along the track 320. When the router head 305 reaches the preset end of the groove 312, the rotational direction of the screw mechanism 355 is reversed and the router head 305 is returned to its starting position. Other methods to move the router head 305 along the track 320 could involve the use of hydraulic or pneumatic mechanisms.

Figure 4:
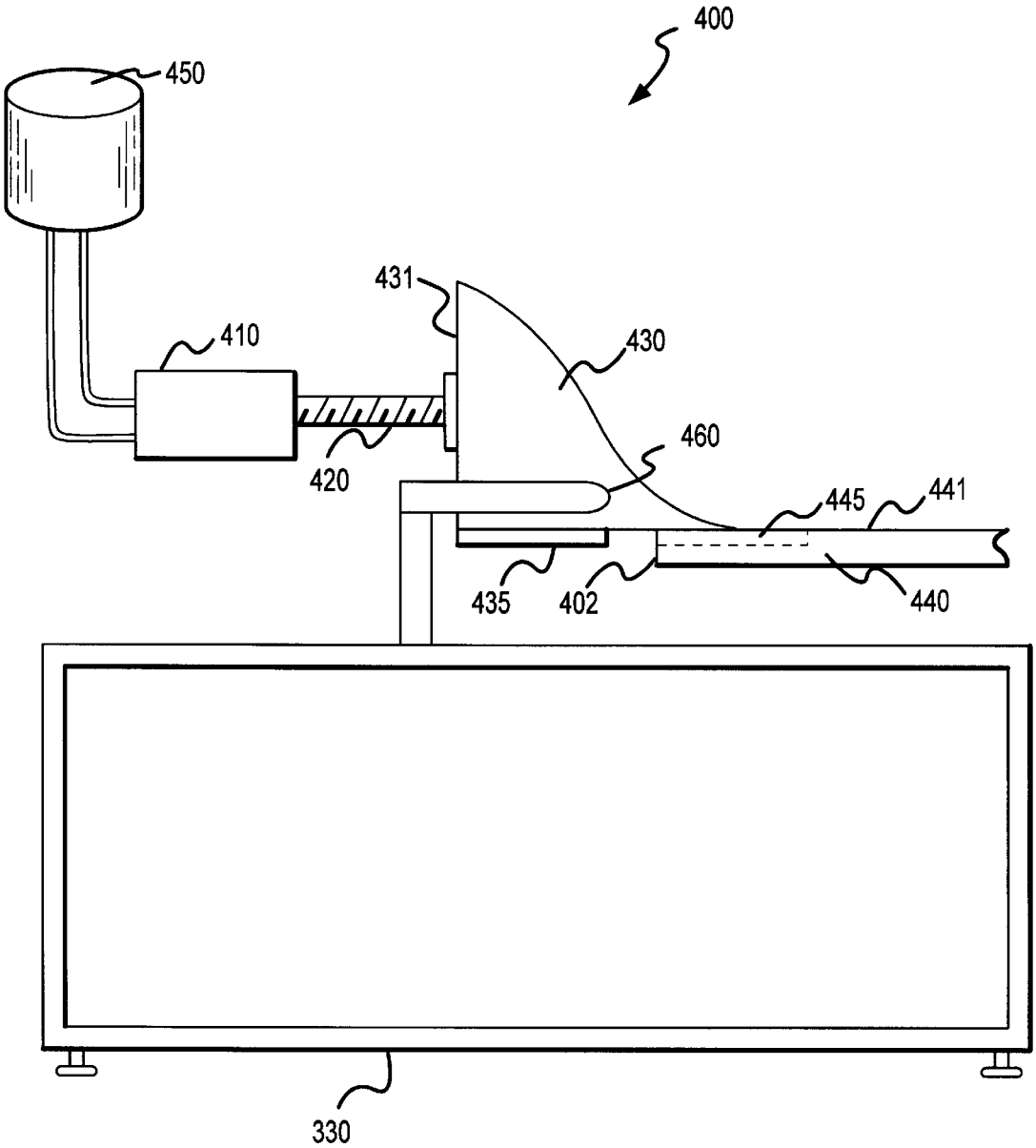
FIG. 4 illustrates a press adapted to press the tenon on a second workpiece into the groove cut on the surface of a first workpiece.

Turning now to FIG. 4, illustrated is a press 400 adapted to press the tenon 435 on a shelf support 430 into a groove cut onto the surface 441 of the shelf 440. A mount 460 holds the shelf support 430 in position with the tenon 435 aligned with the groove 445 on the shelf 440. The press 400 has a cylinder 410 and reciprocating piston 420 adapted to apply pressure against the rear edge 431 of the shelf support 430 and press the tenon 435 into the groove 445.

By referring to FIGS. 1*a*–1*c*, FIGS. 2*a*–2*c*, FIG. 3 and FIG. 4, an embodiment of a dovetailing and dovetail assembly machine with two operating stations can now be described. Coupled to the frame 330 of the machine is a jig 200 that is adapted to hold a shelf 250. A router 300 is coupled to the frame 330 at the first operation station. The router 300 is adapted to cut a groove 312 onto the surface 311 of the shelf 310. After the groove 312 is cut, the jig 200 carries the shelf 310 to the second operating station.

At the second operating station a mount 460 is coupled to the frame 330 to hold the tenon 435 on a shelf support 430 in alignment with the groove 445 on the shelf 440. In one embodiment of the invention, a feeder rack (not illustrated) is also coupled to the frame 330 to supply the shelf support 430 to the mount 460. In another embodiment, the feeder rack holds a plurality of shelf supports 430 in readiness to be supplied to the mount 460.

Also mounted to the frame 330 of the machine at the second station is a press 400. The press 400 has a cylinder 410 and a reciprocating piston 420 aligned to apply pressure to the rear edge 431 of the shelf support 430. After the tenon 435 is aligned with the groove 445, the piston 420 applies sufficient pressure against the rear edge 431 of the shelf support 430 to insert the tenon 435 into the groove 445. The stroke length of the piston 420 is preset to fully insert the tenon 435 into the groove 445. The stroke length is also set so that the rear edge 431 of the shelf support 450 is in alignment with the rear edge 402 of the shelf 440 when the stroke is complete. After the shelf support 430 is mounted on the shelf 440, the piston 420 retracts to its starting position. On one embodiment of the present invention a pneumatic source 450 is coupled to the cylinder 410 to operate the piston 420. The necessary adjustments to regulate the stroke length of the piston 420 are familiar to those skilled in the art.

A particularly beneficial aspect of the machine can now be described. Turning back to FIG. 1*a*–1*c*, if the groove 110 cut into the surface 105 of the shelf 100 has a dovetail shape, a friction fit dovetail joint 175 can be made with a single stroke of the piston 420. Because pressure applied by the piston 420 can be precisely regulated and the groove 110 cut by the router 300 can be precisely sized, a slightly oversized tenon 160 can be used thereby permitting the shelf support 150 to be held in place by friction between the surfaces of the tenon 160 and the groove 110. This eliminates the requirement of using dowels or glue to hold the two parts together. By elimination the use of dowels and glue, a rapid and economical manufacture of low cost shelving is now possible.

The method of manufacturing a dovetailing and assembly machine is clear from the foregoing detailed description and illustrations. In summary, an economical method to manufacture products using dovetail and other grooved joint has been described.

Although one or more embodiments of the present invention have been described in detail, those skilled in the pertinent art should understand that they can make various changes, substitutions and alterations thereto without departing from the spirit and scope of the invention in its broadest form or the claims hereof.

What is claimed is:

1. A dovetailing and assembly machine for forming a groove on the planar surface of a first workpiece and inserting a preformed tenon on one end of a second workpiece into said groove, comprising:

a frame;

a jig coupled to said frame and adapted to hold said first workpiece;

a router coupled to said frame and adapted to move relative to a planar surface on said first workpiece and to cut a groove therein;

a mount coupled to said frame to hold said tenon in substantial alignment with said groove; and a press coupled to said frame adapted to press said tenon into said groove.

2. The machine as recited in claim 1 wherein said frame has a first station for coupling said router and a second station for coupling said mount and said press.

3. The machine as recited in claim 2 wherein said jig is configured to carry said first workpiece from said first station to said second station.

4. The machine as recited in claim 2 wherein a feeder rack is coupled to said frame at said second station to supply said second piece to said mount.

5. The machine as recited in claim 4 wherein said feeder rack holds a plurality of said second pieces.

6. The machine as recited in claim 1 wherein said press is comprised of a cylinder and a reciprocating piston adapted to press said tenon into said groove.

7. The machine as recited in claim 6 wherein said machine has a pneumatic source coupled to said cylinder to operate said piston.

8. The machine as recited in claim 1 wherein said router is coupled to said frame and adapted to move relative to a planar surface on said first workpiece and to cut a dovetail groove therein.

9. A method of manufacturing a machine for forming a groove on the planar surface of a first workpiece and inserting a preformed tenon on one end of a second workpiece into said groove, comprising:

forming a frame;

coupling a jig to said frame that is adapted to hold said first workpiece;

coupling a router to said frame, said router adapted to move relative to a planar surface on said first workpiece and to cut a groove therein;

coupling a mount to said frame to hold said tenon on said second workpiece in substantial alignment with said groove; and coupling a press to said frame, said press adapted to press said tenon into said groove.

10. The method as recited in claim 9 wherein said frame is formed with a first station for coupling said router and a second station for coupling said mount and said press.

11. The method as recited in claim 10 wherein said jig is configured to carry said first workpiece from said first station to said second station.

12. The method as recited in claim 10 wherein a feeder rack is coupled to said frame at said second station to supply said second piece to said mount.

13. The method as recited in claim 12 wherein said feeder rack holds a plurality of said second pieces.

14. The method as recited in claim 9 wherein said press is comprised of a cylinder and a reciprocating piston adapted to press said tenon into said groove.

15. The method as recited in claim 14 wherein said a pneumatic source is coupled to said cylinder to operate said piston.

16. The method as recited in claim 9 wherein said router is coupled to said frame and adapted to move relative to a planar surface on said first workpiece and to cut a dovetail groove therein.

17. A dovetailing and assembly machine for forming a dovetail on the planar surface of a first workpiece and inserting a preformed tenon on one end of a second workpiece into said dovetail, comprising:

a frame having a first station and a second station;

a jig coupled to said frame and adapted to hold said first workpiece and move said first workpiece from said first station to said second station;

a router coupled to said frame at said first station, said router adapted to move relative to a planar surface on said first workpiece and to cut a dovetail therein;

a mount coupled to said frame at said second station configured to hold said tenon in substantial alignment with said dovetail; and a press coupled to said frame at said second station adapted to press said tenon into said dovetail.

18. The machine as recited in claim 17 wherein a feeder rack is coupled to said frame at said second station to supply said second piece to said mount.

19. The machine as recited in claim 18 wherein said feeder rack holds a plurality of said second pieces.

20. The machine as recited in claim 17 wherein said press is comprised of a cylinder and a reciprocating piston adapted to press said tenon into said groove.

21. The machine as recited in claim 20 wherein said machine has a pneumatic source coupled to said cylinder to operate said piston.

* * * * *

UNITED STATES PATENT AND TRADEMARK OFFICE

CERTIFICATE OF CORRECTION

PATENT NO : 6,123,126

DATED : September 26, 2000

INVENTOR(S) : Shanahan et al.

It is certified that error appears in the above-identified patent and that said Letters Patent are hereby corrected as shown below:

Col. 4, line 53, "self" should be --shelf--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*